US011053767B2

(12) United States Patent
Cannon et al.

(10) Patent No.: US 11,053,767 B2
(45) Date of Patent: Jul. 6, 2021

(54) OBJECT LAUNCHING APPARATUS AND RELATED METHODS

(71) Applicant: Downing Wellhead Equipment, LLC, Oklahoma City, OK (US)

(72) Inventors: Nicholas J. Cannon, Washington, OK (US); Joel H. Young, Norman, OK (US); Ronnie B. Beason, Lexington, OK (US)

(73) Assignee: DOWNING WELLHEAD EQUIPMENT, LLC, Oklahoma City, OK (US)

( * ) Notice: Subject to any disclaimer, the term of this patent is extended or adjusted under 35 U.S.C. 154(b) by 0 days.

(21) Appl. No.: 16/801,911

(22) Filed: Feb. 26, 2020

(65) Prior Publication Data

US 2020/0190933 A1 Jun. 18, 2020

Related U.S. Application Data

(63) Continuation of application No. 16/248,633, filed on Jan. 15, 2019, now Pat. No. 10,584,552.

(60) Provisional application No. 62/617,438, filed on Jan. 15, 2018.

(51) Int. Cl.
*E21B 33/068* (2006.01)
*E21B 43/26* (2006.01)

(52) U.S. Cl.
CPC ..... *E21B 33/068* (2013.01); *E21B 43/26* (2013.01)

(58) Field of Classification Search
CPC ..... E21B 33/068
See application file for complete search history.

(56) References Cited

U.S. PATENT DOCUMENTS 2,953,157 A * 9/1960 Osborne ..... F17D 3/08 137/268
3,039,531 A * 6/1962 Scott ..... E21B 33/068 166/70
3,372,705 A 3/1968 Bodhaine
(Continued)

OTHER PUBLICATIONS

Non-Final Office Action dated Apr. 27, 2021 in U.S. Appl. No. 16/803,156, 12 pages.

*Primary Examiner* — Giovanna Wright
(74) *Attorney, Agent, or Firm* — Haynes and Boone, LLP

(57) ABSTRACT

Apparatus and methods for launching objects into a wellbore. The apparatus generally includes a first object container and a container actuator. The first object container includes first compartments. The container actuator is adapted to displace the first object container so that respective ones of the first compartments are sequentially aligned with an opening. When the respective ones of the first compartments are sequentially aligned with the opening, objects loaded into the respective ones of the first compartments are sequentially launchable through the opening and into the wellbore. In some embodiments, the apparatus further includes a second object container including second compartments and being positionable above the first object container so that the respective second compartments are aligned with the respective first compartments. Objects loaded into respective ones of the second compartments are sequentially launchable through the respective ones of the first compartments, through the opening, and into the wellbore.

22 Claims, 12 Drawing Sheets

(56) References Cited

U.S. PATENT DOCUMENTS

2015/0114626 A1* 4/2015 Hatten ..... E21B 33/068
166/250.01

* cited by examiner

ATM = Atmosphere
LL = Load Lock
Well = Well bore

All valves and sensors are in communication with the controller via the Launcher I/O Sequence to drop object into well after release from Launcher:

1. Ensure all valves are closed
2. Open Top EQ Valve (vent the load lock to ATM)
3. Verify Equalization ($PS_{LL}$ = 0)
4. Open Top Valve
5. Delay
6. Close Top Valve
7. Close Top EQ Valve
8. Open Bottom EQ Valve (equalize well to load lock)
9. Verify Equalization ($PS_{Well}$ = $PS_{LL}$)
10. Open Bottom Valve
11. Delay
12. Close Bottom Valve
13. Close Bottom EQ Valve

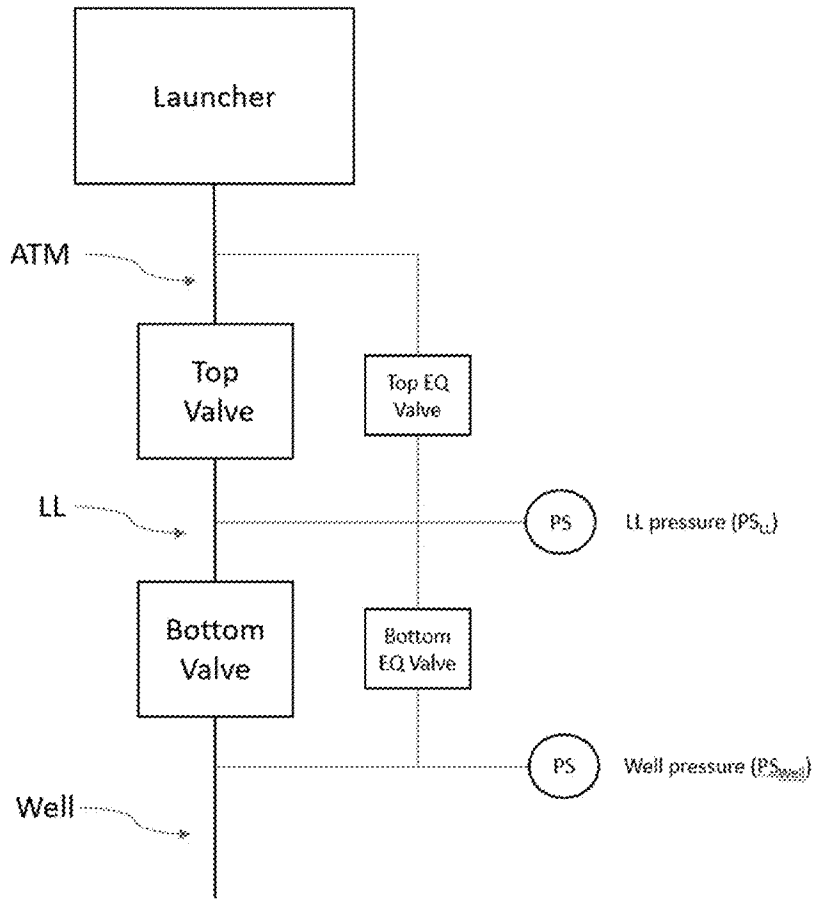

Figure 2A

ATM = Atmosphere
LL = Load Lock
Well = Well bore

All valves and sensors are in communication with the controller via the Launcher I/O Sequence to drop object into well after release from Launcher:

1. Ensure all valves are closed
2. Vent LL thru backside pump (or thru Top EQ Valve)
3. Verify Equalization ($PS_{LL} = 0$)
4. Open Top Valve
5. Delay
6. Close Top Valve
7. Close Top EQ Valve (if used to vent)
8. Bring backside pump to Well pressure
9. Verify Equalization ($PS_{Well} = PS_{LL}$)
10. Open Bottom Valve
11. Delay
12. Close Bottom Valve

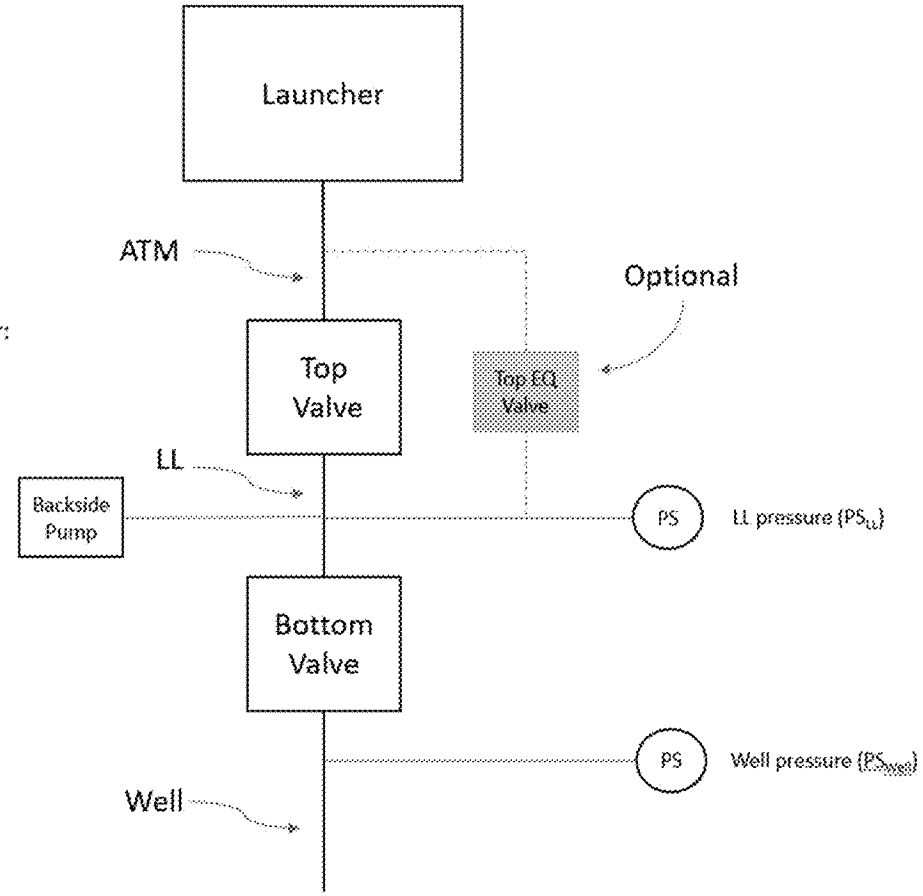

Figure 2B

OBJECT LAUNCHING APPARATUS AND RELATED METHODS

CROSS-REFERENCE TO RELATED APPLICATIONS

This application is a continuation of U.S. application Ser. No. 16/248,633 (the "'633 Application"), filed Jan. 15, 2019, the entire disclosure of which is hereby incorporated herein by reference.

The '633 Application claims the benefit of the filing date of, and priority to, U.S. Application No. 62/617,438, filed Jan. 15, 2018, the entire disclosure of which is hereby incorporated herein by reference.

TECHNICAL FIELD

The present disclosure relates generally to oil and gas operations and, more particularly, to an object launching apparatus and related methods.

BACKGROUND

Due to the rapid expansion of additional fracturing zones involved in fracturing operations for a single well, the oil and gas industry has been driven to develop more efficient and cost effective well fracturing strategies. This has driven the market to produce ball- and sleeve- (or collet) based systems utilizing a number of methods and processes. One such method/process requires the balls dropped to be dissolvable. Other methods/processes require balls to be varied in size to properly be used in certain fracturing operations. Accordingly, there is a need for an object launching apparatus that can house an array of balls, collets, or any other to-be-launched objects in a housing that can be automated to deliver each of these objects in a specified sequence (if required) to a well. It would also be desirable for the object launching apparatus to maintain the array of balls, collets, or other to-be-launched objects in the housing in a dry and low-pressure environment. Therefore, what is needed is an apparatus or method that addressed one or more of the foregoing issues and/or one or more other issues.

BRIEF DESCRIPTION OF THE DRAWINGS

FIG. 2A is a diagrammatic illustration including an example of the one or more other oil and gas tools of FIG. 1 with which the object launching apparatus is operably associated, according to one or more embodiments of the present disclosure.

FIG. 2B is a diagrammatic illustration including another example of the one or more other oil and gas tools of FIG. 1 with which the object launching apparatus is operably associated, according to one or more embodiments of the present disclosure.

DETAILED DESCRIPTION

Figure 1:
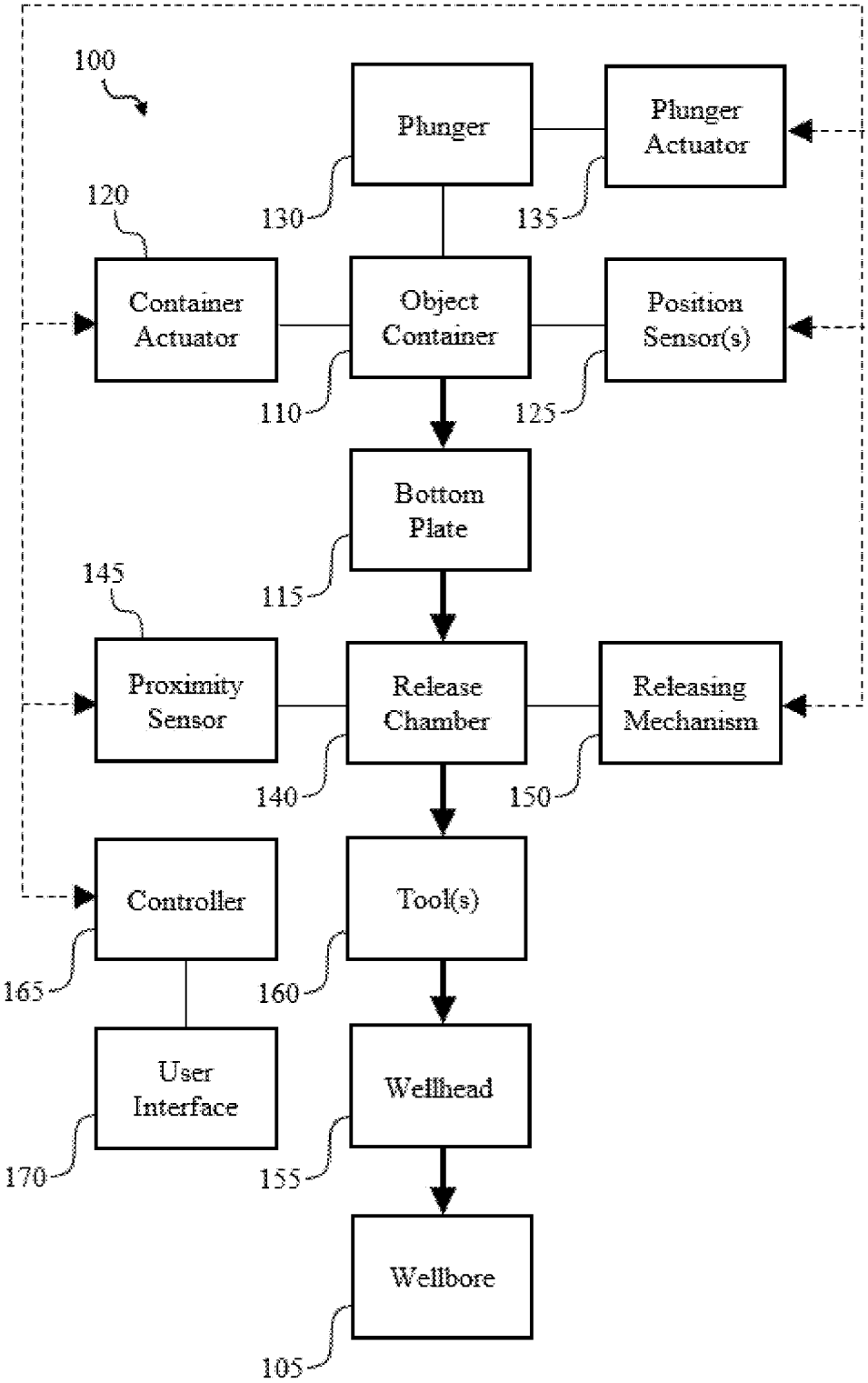
FIG. 1 is a diagrammatic illustration of an object launching apparatus operably associated with a wellbore, a wellhead, and one or more other oil and gas tools, according to one or more embodiments of the present disclosure.

Referring to FIG. 1, in an embodiment, an object launching apparatus is diagrammatically illustrated and generally referred to by the reference numeral 100. The object launching apparatus 100 is adapted to efficiently house and deliver objects into a wellbore 105 for various oilfield operations such as, for example, fracturing operations. In this regard, the object launching apparatus 100 can be designed to launch various types of objects desired to be deposited into the wellbore 105 for a particular oil and gas operation; for example, the objects can be "frac" balls or collets used in fracturing operations.

The object launching apparatus 100 includes an object container 110. In some embodiments, as in FIG. 1, the object container 110 is positioned on a bottom plate 115. A container actuator 120 is operably associated with, and adapted to displace, the object container 110. The container actuator 120 facilitates control and motivation of the object container 110 along multiple axes. The container actuator 120 may be, include, or be part of, motor(s), cylinder actuator(s), other actuators powered by electric, pneumatic, or hydraulic power, or any combination thereof. At the same time, one or more position sensors 125 are adapted to detect the position of the object container 110. The position sensor(s) 125 may be, include, or be part of encoder(s), linear position transducer(s), wire potentiometer(s), another transducer capable of translating linear motion into a mechanical or electrical signal, or any combination thereof.

A plunger 130 is operably associated with, and adapted to launch objects from, the object container 110. A plunger actuator 135 is adapted to displace the plunger 130 to launch objects from the object container 110. A release chamber 140 is adapted to receive objects launched from the object container 110. A proximity sensor 145 is adapted to detect a presence of objects within the release chamber 140 (i.e., objects launched from object container 110). In some embodiments, the proximity sensor 145 is a camera. A releasing mechanism 150 is operably associated with, and adapted to release objects from, the release chamber 140.

The object launching apparatus 100 is operably associated with a wellhead 155. The wellhead 155 serves as the surface termination of the wellbore 105. In some embodiments, as in FIG. 1, one or more oil and gas tools 160 such as, for example, the valve apparatus described in U.S. patent application Ser. No. 15/487,785, filed on Apr. 14, 2017 and published under U.S. patent application publication number US 2017/0298708 A1, the entire disclosure of which is hereby incorporated herein by reference, can be operably associated with the wellhead 155. Accordingly, objects released from the release chamber 140 travel into the wellbore 105 only after passing through the one or more oil and gas tools 160 and the wellhead 155.

A controller 165 is adapted to send control signals to the container actuator 120, the plunger actuator 135, and the releasing mechanism 150, and to receive data from the position sensor(s) 125 and the proximity sensor 145. In some embodiments, the controller 165 is embedded in the object launching apparatus 100. In some embodiments, the controller includes software that runs algorithm(s) to precisely control the position of the object container to drop each object in a pre-specified release sequence. A user interface 170 is operably associated with the controller 165. In some embodiments, the user interface 170 is a laptop or touch panel (HMI).

In some embodiments, the controller 165 is further adapted to control the one or more oil and gas tools 160 and/or other tools/components associated with the wellhead 155. To this end, the controller 165 may include input/output capabilities for controlling: one or more valve(s) operably associated with the wellhead 155 and located above or below the object launching apparatus 100; one or more bleed lines operably associated with the wellhead 155; one or more equalizing lines operably associated with the wellhead 155; one or more backside pumps operably associated with the wellhead 155; or any combination thereof. In addition, or instead, the controller 165 can be configured as a slave device that is controlled from another controller or controllers operably associated with the wellhead 155; accordingly, the controller 165 may be configured to accept commands from the controller or controllers associated with the wellhead 155 in a manner similar to the manner in which the controller 165 accepts commands from the user interface 170 (as described below). An example embodiment of such an arrangement together with the corresponding sequence for dropping an object into the wellbore 105 from the object launching apparatus 100 is illustrated in FIG. 2A. Another example embodiment of such an arrangement together with the corresponding sequence for dropping object(s) into the wellbore 105 from the object launching apparatus 100 is illustrated in FIG. 2B.

Figure 3A:
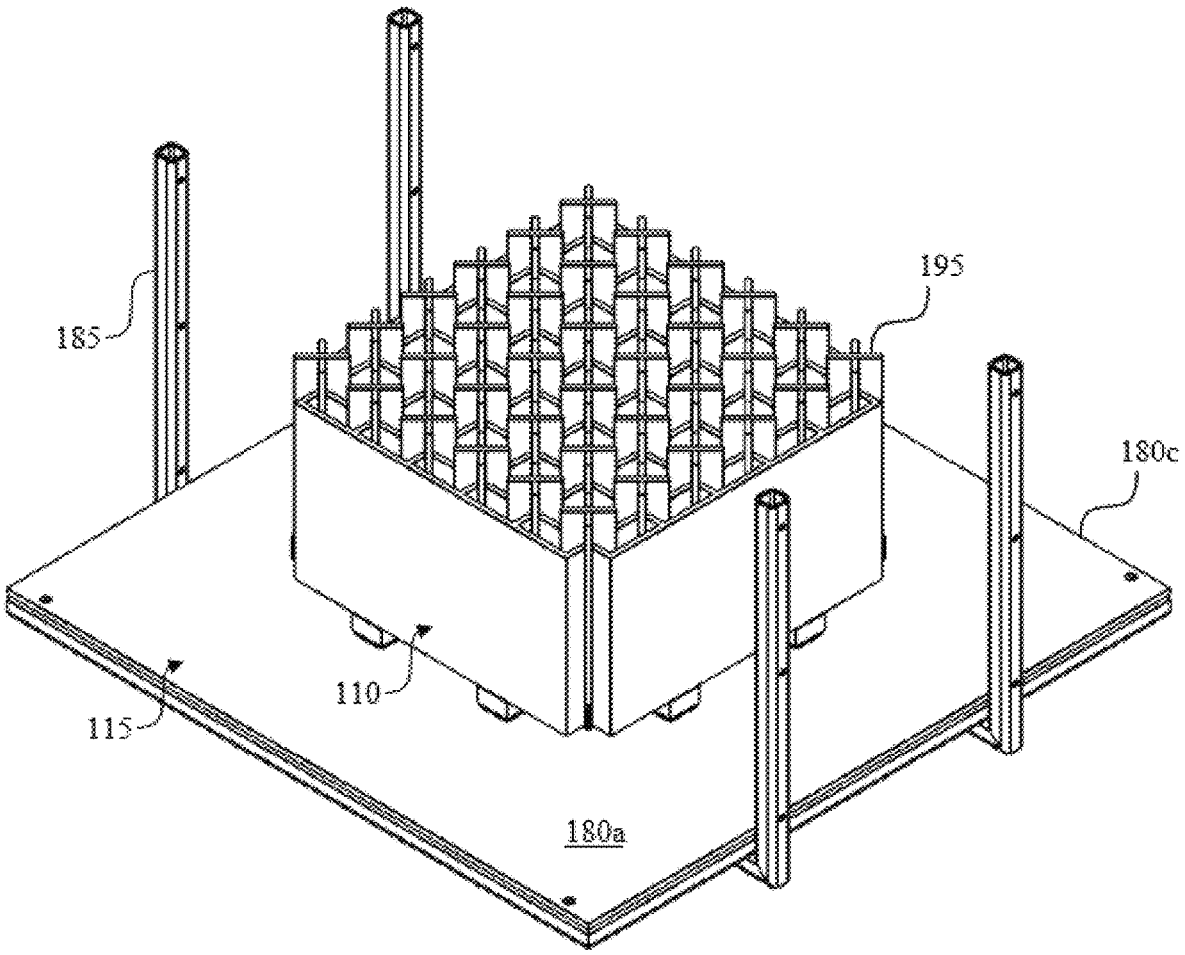
FIG. 3A is a perspective view of an object container and a bottom plate of the object launching apparatus of FIG. 1, according to one or more embodiments of the present disclosure.
Figure 3B:
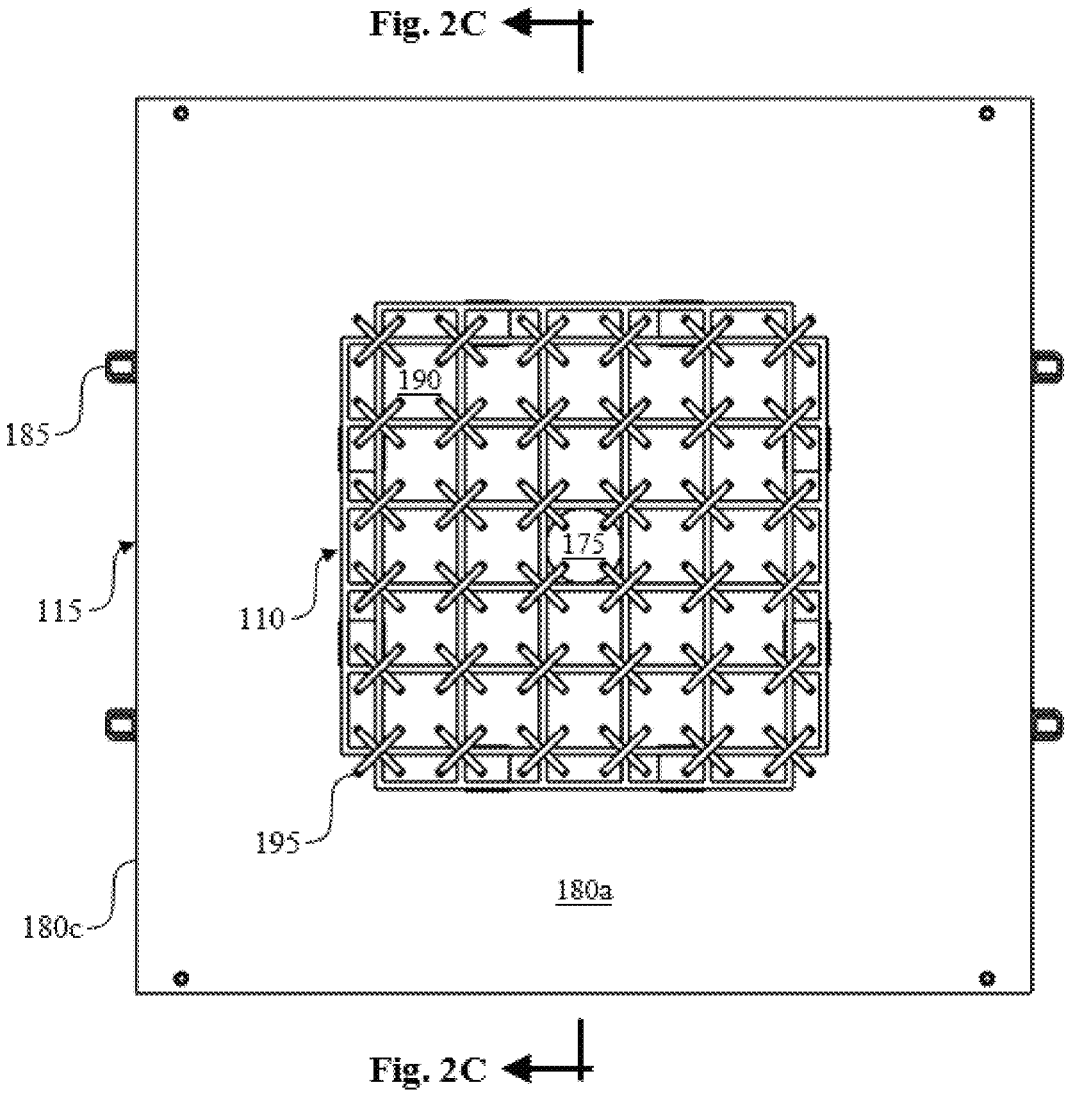
FIG. 3B is a top plan view of the object container and the bottom plate of FIG. 3A, according to one or more embodiments of the present disclosure.
Figure 3C:
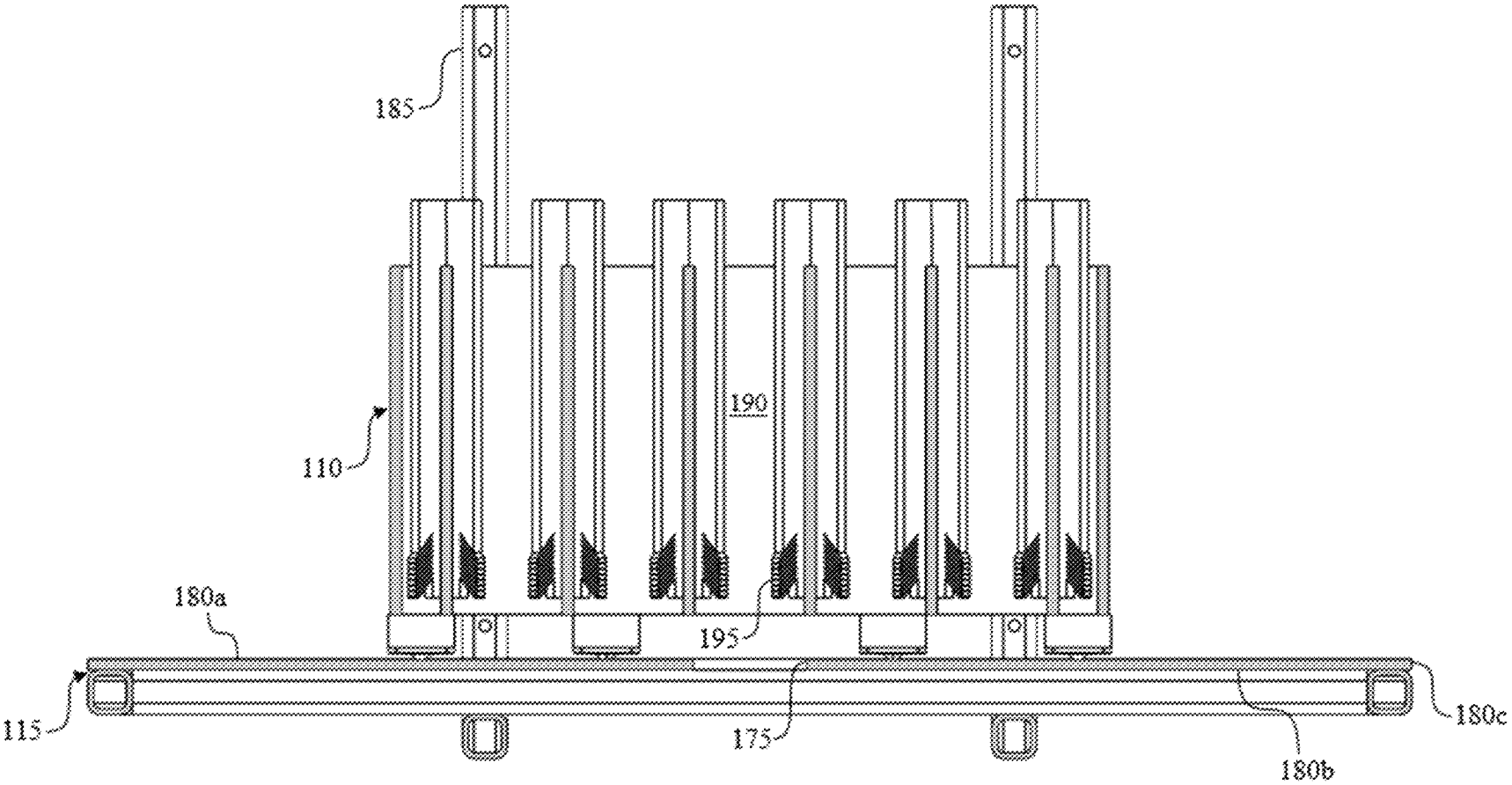
FIG. 3C is a cross-sectional view of the object container and the bottom plate of FIG. 3B taken along the line 3C-3C of FIG. 3B, according to one or more embodiments of the present disclosure.

Referring to FIGS. 3A-C with continuing reference to FIG. 1, an opening 175 is formed through the bottom plate 115 to permit the objects to pass through the bottom plate 115 and into the wellbore 105. The bottom plate 115 is positioned so that the opening 175 is generally aligned with the one or more oil and gas tools 160, the wellhead 155, and/or the wellbore 105. The bottom plate 115 defines opposing side portions 180*a* and 180*b*. The release chamber 140 can be at least partially defined by the space within the opening 175 between the opposing side portions 180*a* and 180*b*. In addition, at least a portion of the release chamber 140 can extend from the side portion 180*b* of the bottom plate 115. In an embodiment, as in FIGS. 3A-C, the object launching apparatus 100 can include vertically disposed guiderails 185 supported by the bottom plate 115 to keep the object container 110 on the bottom plate 115. The guiderails 185 can extend from a perimeter portion 180*c* of the bottom plate and/or from the side portion 180*a* of the bottom plate 115.

The object container 110 includes compartments 190 adapted to contain objects to be launched into the wellbore 105. In some embodiments, each of the compartments 190 is adapted to contain a single object to be launched into the wellbore 105. The object container 110 is movable on the bottom plate 115 to align each of the compartments 190 with the opening 175 so that the object contained therein can be dropped through the opening 175 and into the wellbore 105. In some embodiments, the bottom plate 115 is sized and shaped so that the object container 110 is supported regardless of which compartment 190's object is being released through the opening 175 in the bottom plate 115. Once a particular one of the compartments 190 is aligned with the opening 175, the force of gravity may be sufficient to eject the object through the opening 175 and into the release chamber 140. However, if the force of gravity is not sufficient to eject the object, the plunger 130 can be employed in general alignment with the particular one of the compartments 190 and the opening 175 to push the object into the release chamber 140.

In some embodiments, as in FIGS. 3A-C, the objects are adapted to be contained in the compartments 190 by restraining devices 195. The restraining devices 195 are adapted to prevent, or at least reduce, movement of the objects within the compartment 190 during the oil and gas operation. In some embodiments, as in FIGS. 3A-C, the restraining devices 195 are feather-boards that provide frictional contact on, for example, four sides of the respective objects. In addition, or instead, other suitable restraining devices can be used to prevent, or at least reduce, movement of the objects within the compartments 190.

The compartments 190 can be laid out or oriented in a variety of configurations that allow each one of the compartments 190, and thus the object contained therein, to be aligned with the opening 175 in the bottom plate 115. For example, the layout or orientation of the compartments 190 can be a rectangular pattern, a spiral pattern, a ring pattern, multiple ring patterns, and the like. In an embodiment, the layout or orientation of the compartments 190 is based on a matrix of compartments N×N in number and movable along two primary axes of motion (e.g., x and y). For example, in the embodiment shown in FIGS. 3A-C, a 5×5 matrix of compartments is used to make up the object container, for a total of 25 compartments.

Figure 4A:
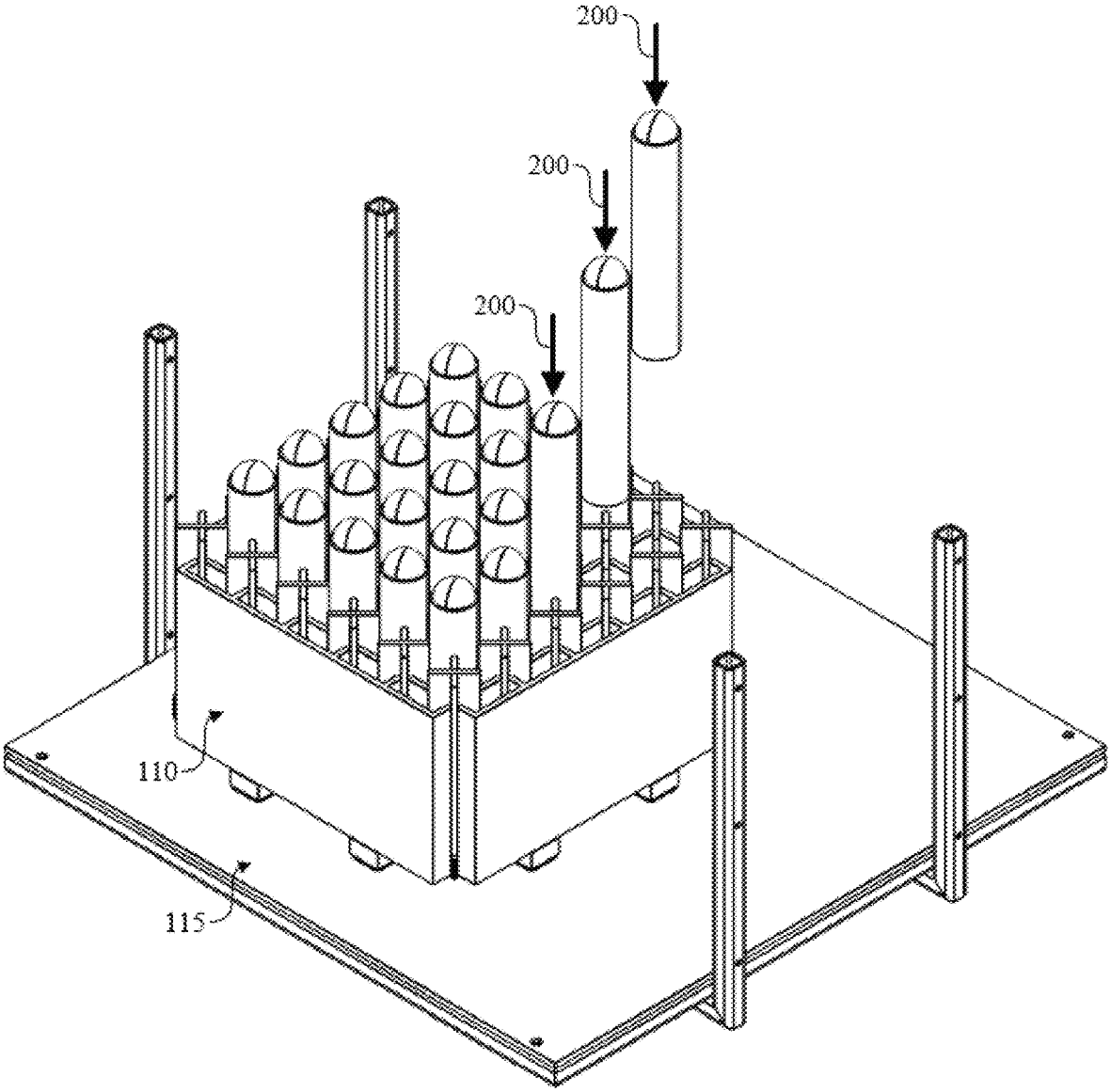
FIG. 4A is a perspective view of the object container and the bottom plate of FIGS. 4A-C as objects desired for a particular oil and gas operation are loaded into the object container, according to one or more embodiments of the present disclosure.
Figure 4B:
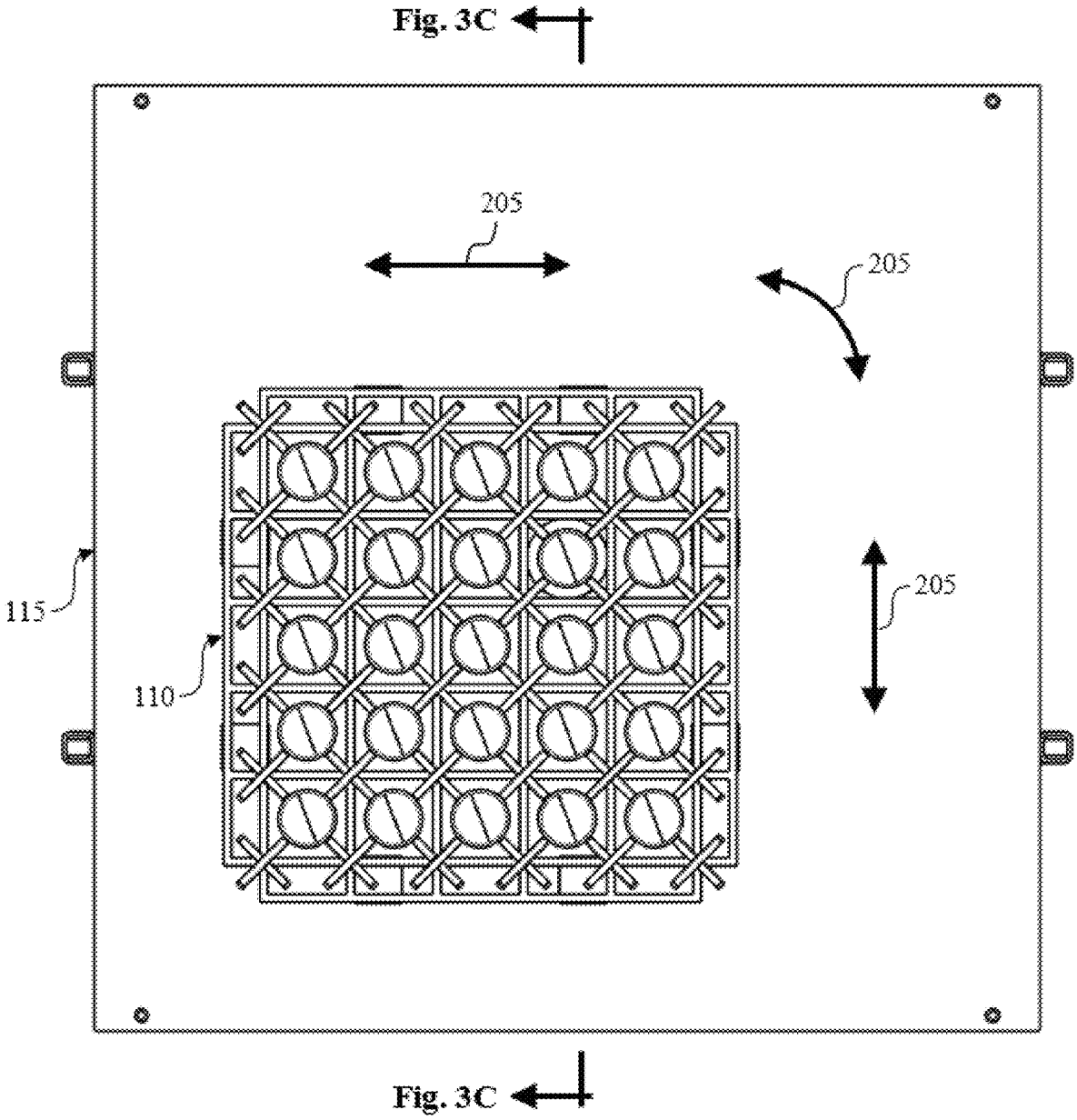
FIG. 4B is a top plan view of the object container and the bottom plate of FIGS. 4A-C in the process of launching one of the loaded objects, according to one or more embodiments of the present disclosure.
Figure 4C:
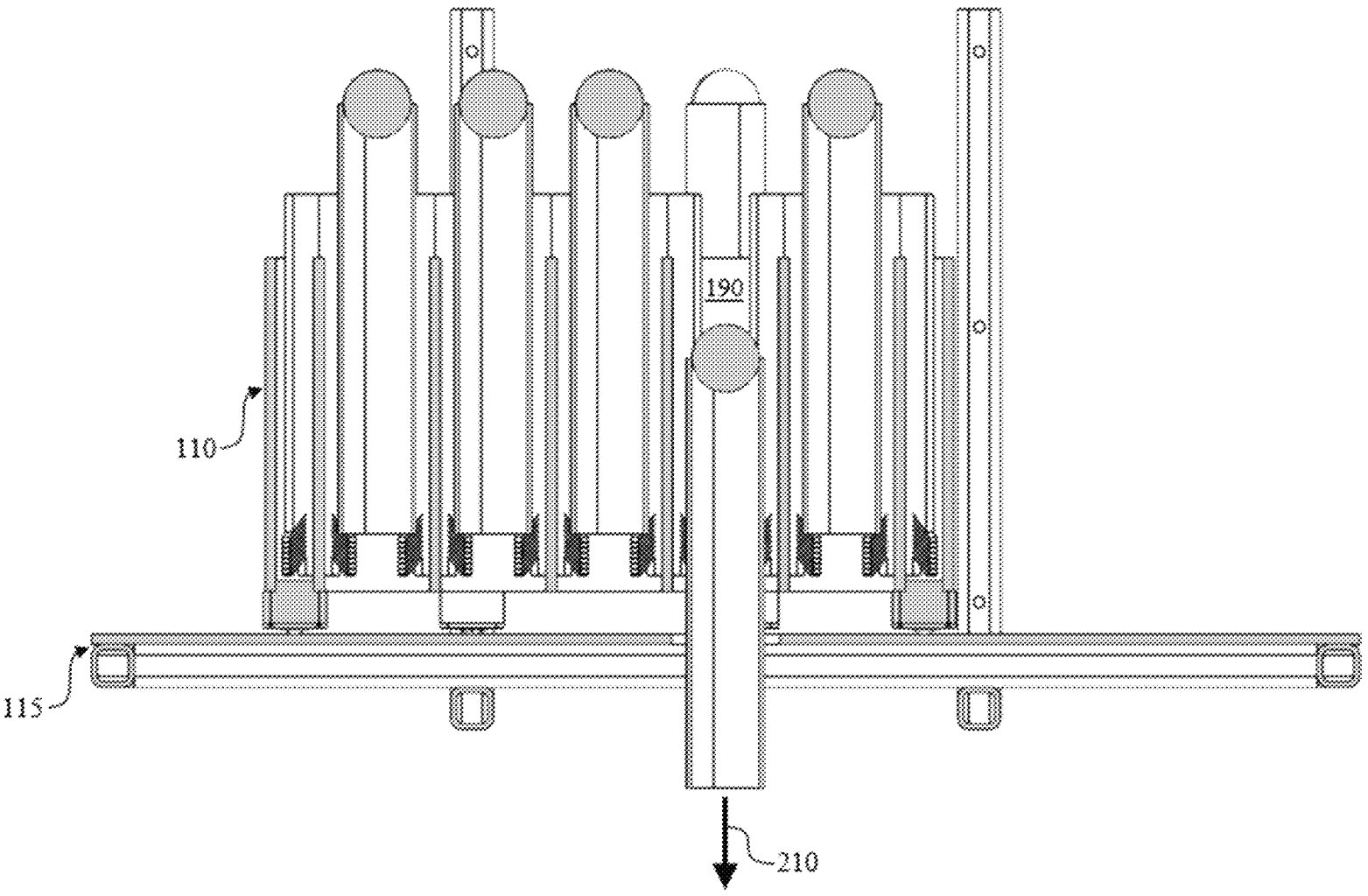
FIG. 4C is a cross-sectional view of the object container and the bottom plate of FIG. 4B taken along the line 4C-4C of FIG. 4B, according to one or more embodiments of the present disclosure.

Referring to FIG. 4A with continuing reference to FIG. 1, in an embodiment, the user interface 170 provides the primary interface with the object launching apparatus 100 before and during operation. Before operation, the desired number and size of each object for a particular job can be entered into the user interface 170 and, once so entered, algorithm(s) in the user interface 170 can assign each object to a specified one of the compartments 190 in the object container 110. This arrangement is then communicated to the operator and the desired objects for the job are loaded into the object container 110, as indicated by arrows 200. Turning to FIG. 4B with continuing reference to FIG. 1, when a desired object is to be released, an operator requests the release via the user interface 170, which request is then sent as a digital message to the controller 165. Once the digital message is received, the software on the controller 165 runs algorithm(s) to generate the appropriate control signals to be sent to the container actuator 120. Upon receiving the control signals, the container actuator 120 moves the object container 110, as indicated by arrows 205, to position the object container 110 at a precise location in which the particular one of the compartments 190 containing the desired object is centered above the opening 175. The controller 165 receives feedback from the position sensor(s) 125 to validate that the particular one of the compartments 190 containing the desired object is in the correct position. Turning to FIG. 4C with continuing reference to FIG. 1, when it is time to release the desired object, the releasing mechanism 150 is opened and, once so opened, either gravity feeds the object downward or, if required, the plunger 130 pushes the object downward, as indicated by arrow 210. The controller 165 receives feedback from the proximity sensor 145 to verify successful release of the desired object and, once so verified, the releasing mechanism 150 is closed. The controller 165 then awaits another message from the user interface 170 to release the next object; in this manner the controlled release sequence can be repeated for all subsequent ones of the compartments 190.

Figure 5:
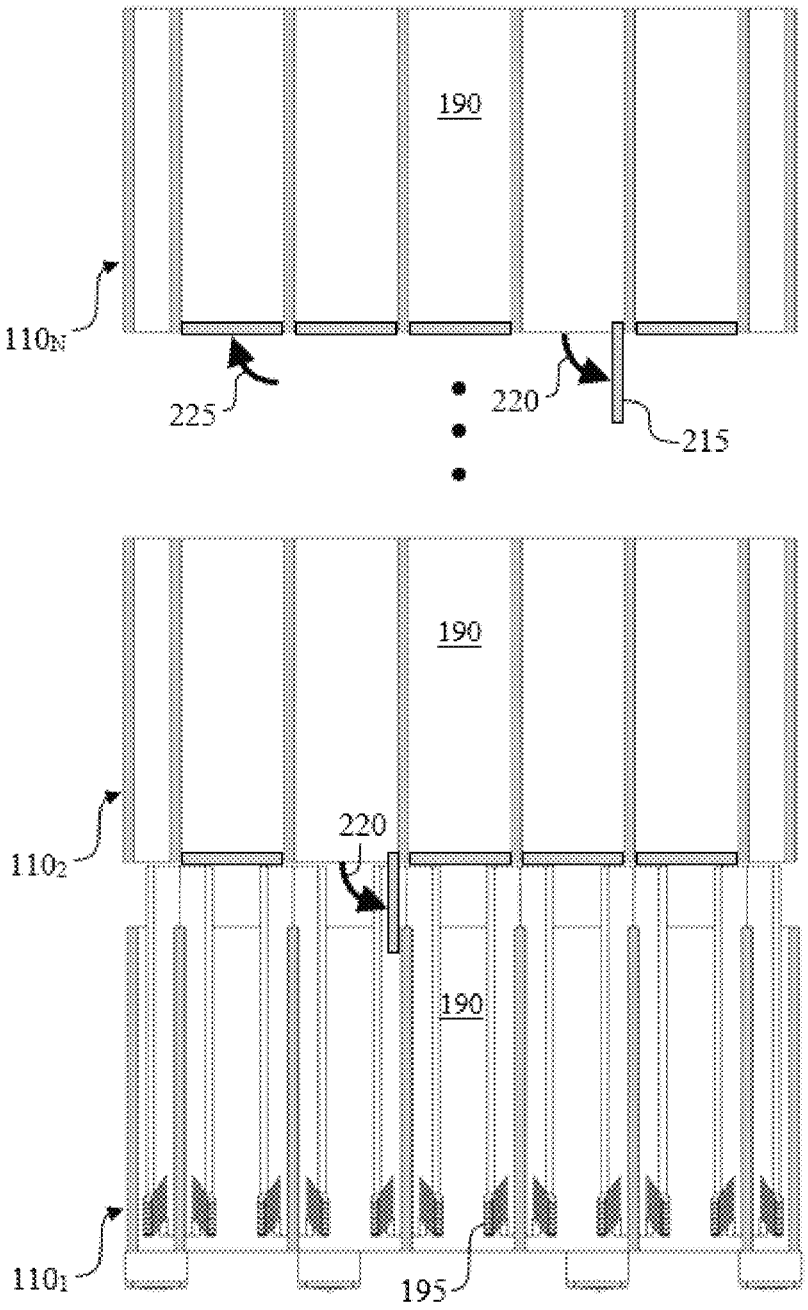
FIG. 5 is a cross-sectional view of an embodiment of the object launching apparatus of FIG. 1 that includes a plurality of object launching containers, according to one or more embodiments of the present disclosure.

Referring to FIG. 5 with continuing reference to FIG. 1, in certain oil and gas operations, it may be desirable to launch a large number of objects into the wellbore 105. To facilitate the launching of large numbers of objects into the wellbore 105, the object launching apparatus 100 can include a plurality of object containers substantially similar to the object container 110, which substantially similar object containers are given the same reference numeral 110, except that a subscript 1, 2, or N is added to each as a suffix. In some embodiments, as in FIG. 5, the object container $\mathbf{110}_1$ can include restraining devices substantially similar to the retraining devices 195 while the object containers $\mathbf{110}_{2\text{-}N}$ do not include restraining devices substantially similar to the retraining devices 195. The object containers $\mathbf{110}_{2\text{-}N}$ each have the same number of compartments 190 as the object container $\mathbf{110}_1$; as a result, the object containers $\mathbf{110}_{2\text{-}N}$ can be stacked or otherwise positioned above the object container $\mathbf{110}_1$ so that the respective compartments 190 of the object containers $\mathbf{110}_{2\text{-}N}$ are substantially aligned with the respective compartments 190 of the object container $\mathbf{110}_1$. In addition, to establish or maintain such substantial alignment, the object containers $\mathbf{110}_{1\text{-}N}$ can each be secured to adjacent one(s) of the object containers $\mathbf{110}_{1\text{-}N}$ (or to alignment components) such that each compartment 190 of a particular one of the object containers $\mathbf{110}_{1\text{-}N}$ is in substantial alignment with the corresponding compartment 190 of an adjacent one of the object containers $\mathbf{110}_{1\text{-}N}$. One or more door elements 215 are operably associated with the compartments 190 of the object containers $\mathbf{110}_{2\text{-}N}$. The door element(s) 215 may be mechanically, hydraulically, pneumatically, or electrically actuable. More particularly, the door element(s) 215 are openable, as indicated by arrows 220, to drop a corresponding object into an aligned one of the compartments 190 positioned below. Once the object has passed into the compartment 190 positioned below, the door element(s) 215 are closable, as indicated by arrows 225.

The door element(s) 215 can each be or include any type of door element capable of dropping objects into the compartment 190 positioned below. For example, the door element(s) 215 can each be or include a door that pivots open or slides open. For another example, the door element(s) 215 can be actuable by a single action to drop all of the loaded objects from one of the object containers $\mathbf{110}_{2\text{-}N}$ into the object container $\mathbf{110}_1$. Accordingly, the door element(s) 215 can include a lattice-type structure located underneath each of the object containers $\mathbf{110}_{2\text{-}N}$ to contain the objects therein. Intersecting portions of the lattice-type structure can be centered under each object during containment. Then, when release of the objects in the one of the object containers $\mathbf{110}_{2\text{-}N}$ is desired, the lattice-type structure is actuated using a single action in the diagonal direction to line up the intersecting portions of the lattice beneath the walls of the one of the object containers $\mathbf{110}_{2\text{-}N}$; this single action releases all of the objects at once into the object container $\mathbf{110}_1$.

In operation, in an embodiment, the object container $\mathbf{110}_1$ is emptied first. Once the object container $\mathbf{110}_1$ is empty, there is available space for additional objects to be launched. Thus, by actuating the door element(s) 215, the object container $\mathbf{110}_2$ above can deliver the objects contained therein to the object container $\mathbf{110}_1$ directly below. In some embodiments, the door element(s) 215 are actuable in a predetermined order to deliver objects to the compartments 190 of the object container $\mathbf{110}_1$ in a particular sequence. In some embodiments, all of the door element(s) 215 belonging to the object containers $\mathbf{110}_2$ are simultaneously actuable. In a similar manner, the object container $\mathbf{110}_{3\text{-}N}$ can be emptied in sequence from bottom to top. More particularly, once the object container $\mathbf{110}_1$ (or at least one of the compartments 190 thereof) is empty, the door element(s) 215 are opened so that the objects contained in the object container $\mathbf{110}_2$ drop into the object container $\mathbf{110}_1$ (or into the at least one of the compartments 190 thereof). In addition, when the object containers $\mathbf{110}_1$ and $\mathbf{110}_2$ (or at least respective ones of the substantially aligned compartments 190 thereof) are empty, the door element(s) 215 are opened so that the objects contained in, for example, the object container $\mathbf{110}_N$ drop into the object container $\mathbf{110}_2$ and then into the object container $\mathbf{110}_1$ (or into the at least respective ones of the substantially aligned compartments 190 thereof). In some embodiments, it is possible to leave all of the door element(s) 215 open after each drop sequence so that subsequently released objects drop directly through all of the compartments 190 positioned below; but some objects may be heavy and/or fragile, therefore a controlled drop (i.e., stopping in each of the object containers $\mathbf{110}_1$, $\mathbf{110}_2$, etc.) can be used.

Figure 6:
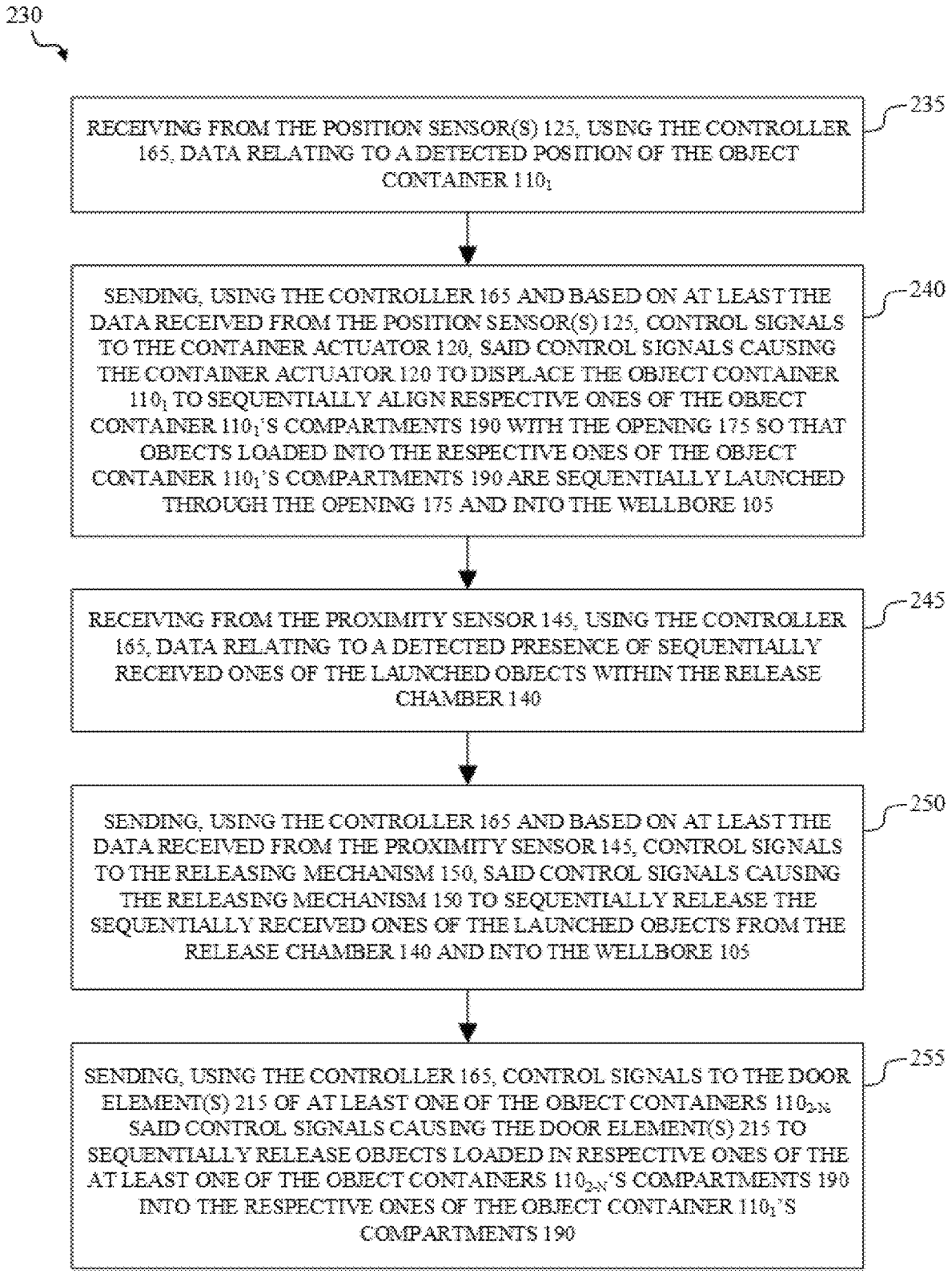
FIG. 6 is a flow diagram of a method for implementing one or more embodiments of the present disclosure.

Referring to FIG. 6, a method of operating the object launching apparatus 100 is diagrammatically illustrated and generally referred to by the reference numeral 230. The method 230 is carried out by receiving, at the controller 265, data from the position sensor(s) 125, the proximity sensor 145, or any combination thereof, and sending, from the controller 265, control signals to the container actuator 120, the plunger actuator 135, the releasing mechanism 150, or any combination thereof. More particularly, the method 230 includes: at a step 235 receiving from the position sensor(s) 125, using the controller 165, data relating to a detected position of the object container $\mathbf{110}_1$; at a step 240 sending, using the controller 165 and based on at least the data received from the position sensor(s) 125, control signals to the container actuator 120, said control signals causing the container actuator 120 to displace the object container $\mathbf{110}_1$ to sequentially align respective ones of the object container $\mathbf{110}_1$'s compartments 190 with the opening 175 so that objects loaded into respective ones of the object container $\mathbf{110}_1$'s compartments 190 are sequentially launched through the opening 175 and into the wellbore 105; at a step 245 receiving from the proximity sensor 145, using the controller 165, data relating to a detected presence of sequentially received ones of the launched objects within the release chamber 140; at a step 250 sending, using the controller 165 and based on at least the data received from the proximity sensor 145, control signals to the releasing mechanism 150, said control signals causing the releasing mechanism 150 to sequentially release objects from the release chamber 140 and into the wellbore 105; and at a step 255 sending, using the controller 165, control signals to the door element(s) 215 of at least one of the object containers $\mathbf{110}_{2\text{-}N}$, said control signals causing the door element(s) 215 to sequentially release objects loaded in respective ones of the at least one of the object containers $\mathbf{110}_{2\text{-}N}$'s compartments 190 into the respective ones of the object container $\mathbf{110}_1$'s compartments 190. In some embodiments, the method 230 further includes sending, using the controller 165, control signals to the plunger actuator 135, said control signals causing the plunger actuator 135 to displace the plunger 130 to eject objects from the respective ones of the object container $\mathbf{110}_1$'s compartments 190 so that the objects are launched through the opening 175 and into the wellbore 105.

In some embodiments, among other things, the operation of the object launching apparatus 100 and/or the execution of the method 230: facilitates more efficient and cost effective well fracturing strategies; provides an array of balls, collets, or other to-be-launched objects in a housing that can be automated to deliver each of these objects in a specified sequence to the wellbore 105; and maintains the array of balls, collets, or other to-be-launched objects in the housing in a dry and low-pressure environment.

Figure 7:
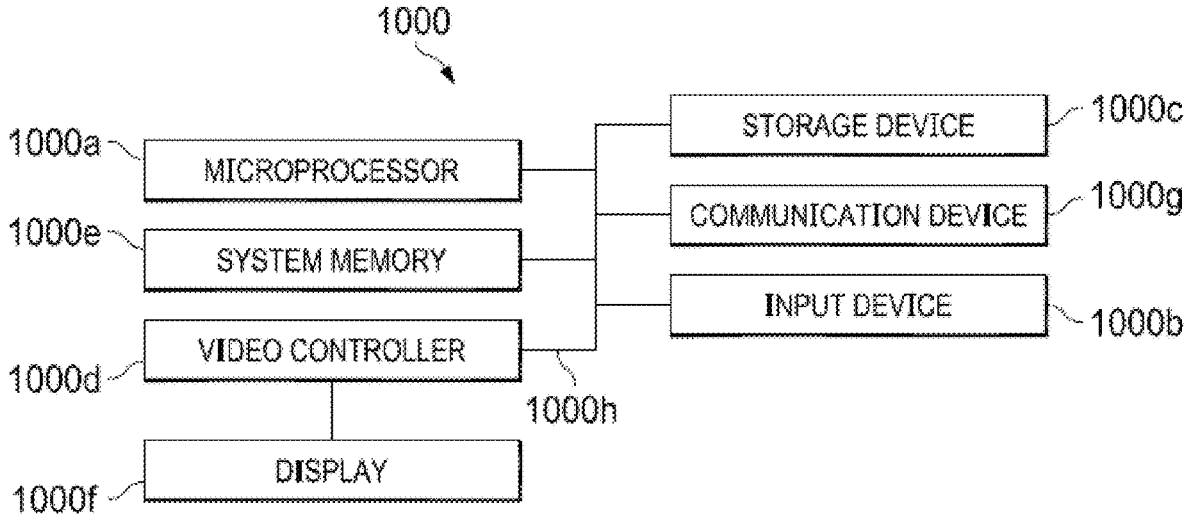
FIG. 7 is a diagrammatic illustration of a computing node for implementing one or more embodiments of the present disclosure.

Referring to FIG. 7, in an embodiment, a computing node 1000 for implementing one or more embodiments of one or more of the above-described elements, controllers (e.g., 165), user interfaces (e.g., 170), apparatus (e.g., 100), methods (e.g., 230) and/or steps (e.g., 235, 240, 245, 250, and/or 255), or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several embodiments, the storage device 1000*c* can include a floppy drive, hard drive, CD-ROM, optical drive, any other form of storage device or any combination thereof. In several embodiments, the storage device 1000*c* can include, and/or be capable of receiving, a floppy disk, CD-ROM, DVD-ROM, or any other form of computer-readable medium that can contain executable instructions. In several embodiments, the communication device 1000*g* can include a modem, network card, or any other device to enable the node 1000 to communicate with other nodes. In several embodiments, any node represents a plurality of interconnected (whether by intranet or Internet) computer systems, including without limitation, personal computers, mainframes, PDAs, smartphones and cell phones.

In several embodiments, one or more of the components of any of the above-described systems include at least the node 1000 and/or components thereof, and/or one or more nodes that are substantially similar to the node 1000 and/or components thereof. In several embodiments, one or more of the above-described components of the node 1000 and/or the above-described systems include respective pluralities of same components.

In several embodiments, a computer system typically includes at least hardware capable of executing machine readable instructions, as well as the software for executing acts (typically machine-readable instructions) that produce a desired result. In several embodiments, a computer system can include hybrids of hardware and software, as well as computer sub-systems.

In several embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several embodiments, hardware can include any physical device that is capable of storing machine-readable instructions, such as memory or other data storage devices. In several embodiments, other forms of hardware include hardware sub-systems, including transfer devices such as modems, modem cards, ports, and port cards, for example.

In several embodiments, software includes any machine code stored in any memory medium, such as RAM or ROM, and machine code stored on other devices (such as floppy disks, flash memory, or a CD ROM, for example). In several embodiments, software can include source or object code. In several embodiments, software encompasses any set of instructions capable of being executed on a node such as, for example, on a client machine or server.

In several embodiments, combinations of software and hardware could also be used for providing enhanced functionality and performance for certain embodiments of the present disclosure. In an embodiment, software functions can be directly manufactured into a silicon chip. Accordingly, it should be understood that combinations of hardware and software are also included within the definition of a computer system and are thus envisioned by the present disclosure as possible equivalent structures and equivalent methods.

In several embodiments, computer readable mediums include, for example, passive data storage, such as a random-access memory (RAM) as well as semi-permanent data storage such as a compact disk read only memory (CD-ROM). One or more embodiments of the present disclosure can be embodied in the RAM of a computer to transform a standard computer into a new specific computing machine. In several embodiments, data structures are defined organizations of data that can enable an embodiment of the present disclosure. In an embodiment, data structure can provide an organization of data, or an organization of executable code.

In several embodiments, any networks and/or one or more portions thereof, can be designed to work on any specific architecture. In an embodiment, one or more portions of any networks can be executed on a single computer, local area networks, client-server networks, wide area networks, internets, hand-held and other portable and wireless devices and networks.

In several embodiments, database can be any standard or proprietary database software. In several embodiments, the database can have fields, records, data, and other database elements that can be associated through database specific software. In several embodiments, data can be mapped. In several embodiments, mapping is the process of associating one data entry with another data entry. In an embodiment, the data contained in the location of a character file can be mapped to a field in a second table. In several embodiments, the physical location of the database is not limiting, and the database can be distributed. In an embodiment, the database can exist remotely from the server, and run on a separate platform. In an embodiment, the database can be accessible across the Internet. In several embodiments, more than one database can be implemented.

In several embodiments, a plurality of instructions stored on a computer readable medium can be executed by one or more processors to cause the one or more processors to carry out or implement in whole or in part the above-described operation of each of the above-described elements, controllers (e.g., 165), user interfaces (e.g., 170), apparatus (e.g., 100), methods (e.g., 230) and/or steps (e.g., 235, 240, 245, 250, and/or 255), or any combination thereof. In several embodiments, such a processor can include one or more of the microprocessor 1000*a*, any processor(s) that are part of the components of the above-described systems, and/or any combination thereof, and such a computer readable medium can be distributed among one or more components of the above-described systems. In several embodiments, such a processor can execute the plurality of instructions in connection with a virtual computer system. In several embodiments, such a plurality of instructions can communicate directly with the one or more processors, and/or can interact with one or more operating systems, middleware, firmware, other applications, and/or any combination thereof, to cause the one or more processors to execute the instructions.

An apparatus for launching objects into a wellbore has been disclosed. The apparatus generally includes a first object container including first compartments; and a container actuator adapted to displace the first object container so that respective ones of the first compartments are sequentially aligned with an opening; wherein, when the respective ones of the first compartments are sequentially aligned with the opening, objects loaded into the respective ones of the first compartments are sequentially launchable through the opening and into the wellbore.

The foregoing apparatus embodiment may include one or more of the following elements/limitations, either alone or in combination with one another:

The first object container further includes restraining devices adapted to prevent, or at least reduce, movement of objects loaded within the first compartments.

The apparatus further includes a bottom plate into which the opening is formed, the bottom plate supporting the object container and being operably associated with a wellhead, and the wellhead serving as a surface termination of the wellbore.

The bottom plate is sized and shaped to support the first object container regardless of which one of the first compartments is aligned with the opening.

The apparatus further includes a release chamber adapted to sequentially receive the objects when the objects are sequentially launched through the opening; a proximity sensor adapted to detect a presence of each object sequentially received within the release chamber; and a releasing mechanism adapted to sequentially release objects from the release chamber and into the wellbore.

The apparatus further includes a plunger; and a plunger actuator adapted to displace the plunger to eject loaded objects from the respective ones of the first compartments so that the loaded objects are launched through the opening and into the wellbore.

The apparatus further includes a second object container including second compartments, the second object container being positionable above the first object container so that the respective second compartments are aligned with the respective first compartments; wherein, when the respective ones of the first compartments are sequentially aligned with the opening, objects loaded into respective ones of the second compartments are sequentially launchable through the respective ones of the first compartments, through the opening, and into the wellbore.

The second object container further includes one or more door elements adapted to sequentially release the objects loaded in the respective ones of the second compartments into the respective ones of the first compartments.

A method for launching objects into a wellbore has also been disclosed. The method generally includes receiving from a position sensor, using a controller, data relating to a detected position of a first object container, the first object container including first compartments; and based on at least the data received from the position sensor, sending, using the controller, control signals to a container actuator, said control signals causing the container actuator to displace the first object container to sequentially align respective ones of the first compartments with an opening so that objects loaded into the respective ones of the first compartments are sequentially launched through the opening and into the wellbore.

The foregoing method embodiment may include one or more of the following elements/limitations, either alone or in combination with one another:

The method further includes preventing, or at least reducing, movement of objects loaded within the first compartments using restraining devices of the first object container.

The method further includes supporting the object container with a bottom plate into which the opening is formed, the bottom plate being operably associated with a wellhead, and the wellhead serving as a surface termination of the wellbore.

The bottom plate is sized and shaped to support the first object container regardless of which one of the first compartments is aligned with the opening.

The method further includes receiving from a proximity sensor, using the controller, data relating to a detected presence of sequentially received objects within a release chamber; and based on at least the data received from the proximity sensor, sending, using the controller, control signals to a releasing mechanism, said control signals causing the releasing mechanism to sequentially release objects from the release chamber and into the wellbore.

The method further includes sending, using the controller, control signals to a plunger actuator, said control signals causing the plunger actuator to displace a plunger to eject loaded objects from the respective ones of the first compartments so that the loaded objects are launched through the opening and into the wellbore.

A second object container including second compartments is positioned above the first object container so that the respective second compartments are aligned with the respective first compartments; and, when the respective ones of the first compartments are sequentially aligned with the opening, objects loaded in respective ones of the second compartments are sequentially launchable through the respective ones of the first compartments, through the opening, and into the wellbore.

The second object container further includes one or more door elements; and the method further includes sending, using the controller, control signals to the one or more door elements, said control signals causing the one or more door elements to sequentially release the objects loaded in the respective ones of the second compartments into the respective ones of the first compartments.

Another apparatus has also been disclosed. The another apparatus generally includes a non-transitory computer readable medium; and a plurality of instructions stored on the non-transitory computer readable medium and executable by one or more processors, the plurality of instructions including: instructions that, when executed, cause the one or more processors to receive from a position sensor, using a controller, data relating to a detected position of a first object container, the first object container including first compartments; and instructions that, when executed, cause the one or more processors to send, using the controller and based on at least the data received from the position sensor, control signals to a container actuator, said control signals causing the container actuator to displace the first object container to sequentially align respective ones of the first compartments with an opening so that objects loaded into the respective ones of the first compartments are sequentially launched through the opening and into a wellbore.

The foregoing apparatus embodiment may include one or more of the following elements/limitations, either alone or in combination with one another:

The plurality of instructions further includes instructions that, when executed, cause the one or more processors to receive from a proximity sensor, using the controller, data relating to a detected presence of sequentially received objects within a release chamber; and instructions that, when executed, cause the one or more processors to send, using the controller and based on at least the data received from the proximity sensor, control signals to a releasing mechanism, said control signals causing the releasing mechanism to sequentially release objects from the release chamber and into the wellbore.

The plurality of instructions further includes instructions that, when executed, cause the one or more processors to send, using the controller, control signals to a plunger actuator, said control signals causing the plunger actuator to displace a plunger to eject loaded objects from the respective ones of the first compartments so that the loaded objects are launched through the opening and into the wellbore.

A second object container including second compartments is positioned above the first object container so that the respective second compartments are aligned with the respective first compartments, the second object container further including one or more door elements; when the respective ones of the first compartments are sequentially aligned with the opening, objects loaded in respective ones of the second compartments are sequentially launchable through the respective ones of the first compartments, through the opening, and into the wellbore; and wherein the plurality of instructions further includes instructions that, when executed, cause the one or more processors to send, using the controller, control signals to the one or more door elements, said control signals causing the one or more door elements to sequentially release the objects loaded in the respective ones of the second compartments into the respective ones of the first compartments.

It is understood that variations can be made in the foregoing without departing from the scope of the present disclosure.

In some embodiments, the elements and teachings of the various embodiments can be combined in whole or in part in some or all of the embodiments. In addition, one or more of the elements and teachings of the various embodiments can be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures can also be performed in different orders, simultaneously and/or sequentially. In some embodiments, the steps, processes, and/or procedures can be merged into one or more steps, processes and/or procedures.

In some embodiments, one or more of the operational steps in each embodiment can be omitted. Moreover, in some instances, some features of the present disclosure can be employed without a corresponding use of the other features. Moreover, one or more of the above-described embodiments and/or variations can be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims.

What is claimed is:

1. A method, comprising:

imparting, using a container actuator, rotational motion to a first object container, in a non-vertical plane of rotation, from a first angular position to a second angular position, wherein the first object container includes a first compartment and is operably associated with a wellhead;

supporting the first object container with a bottom plate while the container actuator imparts rotational motion to the first object container;

launching, when the first object container is in the second angular position, a first object loaded into the first compartment from the first compartment into the wellhead, wherein launching the first object from the first compartment into the wellhead comprises pushing the first object using a component operably associated with the first object container;

and loading, after the first object has been launched from the first compartment into the wellhead, a second object from a second compartment into the first compartment, wherein a second object container includes the second compartment, the second object container being operably associated with the first object container.

2. The method of claim 1, wherein the plane of rotation is horizontal.

3. The method of claim 1, further comprising launching, when the first object container is in the second angular position, the second object loaded into the first compartment from the first compartment into the wellhead.

4. The method of claim 1, further comprising preventing, or at least reducing, using restraining devices of the first object container, movement of the first and/or second objects when loaded within the first compartment.

5. The method of claim 1, wherein loading the second object from the second compartment into the first compartment comprises:

releasing the second object from the second compartment into the first compartment with a door element of the second object container.

6. The method of claim 1, wherein launching the first object from the first compartment into the wellhead comprises:

receiving the first object from the first compartment into a release chamber.

7. The method of claim 6, wherein launching the first object from the first compartment into the wellhead further comprises:

releasing the first object from the release chamber and into the wellhead.

8. The method of claim 7, wherein launching the first object from the first compartment into the wellhead further comprises:

detecting a presence of the first object within the release chamber with a proximity sensor.

9. The method of claim 1, wherein the component is or includes a plunger adapted to push the first object downwardly to thereby launch the first object from the first compartment into the wellhead.

10. A method, comprising:

imparting, using a container actuator, rotational motion to a first object container, in a non-vertical plane of rotation, from a first angular position to a second angular position, wherein the first object container includes a first compartment and is operably associated with a wellhead;

supporting the first object container with a bottom plate while the container actuator imparts rotational motion to the first object container;

launching, when the first object container is in the second angular position, a first object loaded into the first compartment from the first compartment into the wellhead, wherein launching the first object from the first compartment into the wellhead comprises:

ejecting the first object from the first compartment with a plunger;

and loading, after the first object has been launched from the first compartment into the wellhead, a second object from a second compartment into the first compartment, wherein a second object container includes the second compartment, the second object container being operably associated with the first object container.

11. The method of claim 10, wherein ejecting the first object from the first compartment with the plunger comprises:

displacing the plunger with a plunger actuator to eject the first object from the first compartment.

12. An apparatus, comprising:

a first object container adapted to be operably associated with a wellhead, the first object container including a first compartment;

a container actuator adapted to impart rotational motion to the first object container, in a plane of rotation, from a first angular position to a second angular position, wherein, when the first object container is operably associated with the wellhead, the plane of rotation is non-vertical, and wherein, when the first object container is operably associated with the wellhead and positioned in the second angular position, a first object loaded into the first compartment is adapted to be launched from the first compartment into the wellhead;

a component operably associated with the first object container, wherein, when the first object container is operably associated with the wellhead and positioned in the second angular position, the component is adapted to push the first object, thereby launching the first object from the first compartment into the wellhead;

a bottom plate adapted to support the first object container while the container actuator imparts the rotational motion to the first object container; and a second object container operably associated with the first object container, the second object container including a second compartment, wherein, when the first object container is operably associated with the wellhead and after the first object is launched from the first compartment into the wellhead, a second object is adapted to be loaded from the second compartment into the first compartment.

13. The apparatus of claim 12, wherein, when the first object container is operably associated with the wellhead, the plane of rotation is horizontal.

14. The apparatus of claim 12, wherein, after the second object has been loaded from the second compartment into the first compartment, when the first object container is operably associated with the wellhead and positioned in the second angular position, the second object loaded into the first compartment is adapted to be launched from the first compartment into the wellhead.

15. The apparatus of claim 12, wherein the first object container further comprises:

restraining devices adapted to prevent, or at least reduce, movement of the first and/or second objects when loaded within the first compartment.

16. The apparatus of claim 12, wherein the second object container further includes a door element adapted to release the second object from the second compartment into the first compartment.

17. The apparatus of claim 12, further comprising:

a release chamber adapted to receive the first object from the first compartment after the first object is launched from the first compartment.

18. The apparatus of claim 17, further comprising:

a releasing mechanism adapted to release the first object from the release chamber and into the wellhead after the first object is received within the release chamber.

19. The apparatus of claim 18, further comprising:

a proximity sensor adapted to detect a presence of the first object within the release chamber.

20. The apparatus of claim 12, wherein the component is or includes a plunger adapted to push the first object downwardly to thereby launch the first object from the first compartment into the wellhead.

21. An apparatus, comprising:

a first object container adapted to be operably associated with a wellhead, the first object container including a first compartment;

a container actuator adapted to impart rotational motion to the first object container, in a plane of rotation, from a first angular position to a second angular position, wherein, when the first object container is operably associated with the wellhead, the plane of rotation is non-vertical, and wherein, when the first object container is operably associated with the wellhead and positioned in the second angular position, a first object loaded into the first compartment is adapted to be launched from the first compartment into the wellhead;

a bottom plate adapted to support the first object container while the container actuator imparts the rotational motion to the first object container;

a second object container operably associated with the first object container, the second object container including a second compartment, wherein, when the first object container is operably associated with the wellhead and after the first object is launched from the first compartment into the wellhead, a second object is adapted to be loaded from the second compartment into the first compartment;

and a plunger adapted to eject the first object from the first compartment.

22. The apparatus of claim 21, further comprising:

a plunger actuator adapted to displace the plunger to eject the first object from the first compartment.

* * * * *